US009375820B2

(12) United States Patent
Hsu et al.

(10) Patent No.: US 9,375,820 B2
(45) Date of Patent: Jun. 28, 2016

(54) METHOD AND SYSTEM FOR FINISHING GLASS SHEETS

(71) Applicant: Corning Incorporated, Corning, NY (US)

(72) Inventors: Tzu-Hen Hsu, Taichung (TW); James Guy Oliver, Horseheads, NY (US); Yuyin Tang, Dongguan (CN); Qing Ya Wang, Changchun (CN); Xinhao Zhang, Shanghai (CN)

(73) Assignee: CORNING INCORPORATED, Corning, NY (US)

( * ) Notice: Subject to any disclaimer, the term of this patent is extended or adjusted under 35 U.S.C. 154(b) by 40 days.

(21) Appl. No.: 13/803,994

(22) Filed: Mar. 14, 2013

(65) Prior Publication Data

US 2013/0273810 A1 Oct. 17, 2013

Related U.S. Application Data

(63) Continuation of application No. 61/624,584, filed on Apr. 16, 2012.

(51) Int. Cl.
*B24B 9/10* (2006.01)
*B24B 9/06* (2006.01)

(52) U.S. Cl.
CPC .. *B24B 9/065* (2013.01); *B24B 9/10* (2013.01)

(58) Field of Classification Search
CPC ..... B24B 9/08; B24B 9/065
USPC ..... 451/5, 44, 43, 365, 57, 58
See application file for complete search history.

(56) References Cited

U.S. PATENT DOCUMENTS

| | | | | |
|---|---|---|---|---|
| 2,356,433 | A * | 8/1944 | Roesch et al. | 451/273 |
| 4,777,768 | A * | 10/1988 | Audi et al. | 451/127 |
| 5,727,990 | A * | 3/1998 | Hasegawa et al. | 451/44 |
| 6,615,613 | B1 * | 9/2003 | Iwabuchi et al. | 65/61 |
| 6,845,635 | B2 | 1/2005 | Watanabe et al. | |
| 8,231,433 | B2 * | 7/2012 | Haneda et al. | 451/44 |
| 8,408,970 | B2 | 4/2013 | Ueda | |
| 2002/0037687 | A1 * | 3/2002 | Yamahara | 451/43 |
| 2003/0082999 | A1 * | 5/2003 | Yoshikawa et al. | 451/41 |
| 2007/0196699 | A1 * | 8/2007 | Aida | 428/846.1 |
| 2009/0038743 | A1 * | 2/2009 | Suzuki | G11B 5/8404 156/154 |
| 2010/0285726 | A1 * | 11/2010 | Ueda | B24B 5/04 451/41 |

FOREIGN PATENT DOCUMENTS

| | | |
|---|---|---|
| CN | 1058366 | 3/1993 |
| CN | 101356575 | 9/2011 |
| JP | 2002150546 | 5/2002 |
| JP | 2008302448 | 12/2008 |

OTHER PUBLICATIONS

English Translation of Notice on the First Office Action for CN Appl No. 201310225850.7, dated Feb. 1, 2016, 10 pages.

* cited by examiner

*Primary Examiner* — Robert Rose
(74) *Attorney, Agent, or Firm* — John T. Haran

(57) ABSTRACT

A method of finishing glass sheets includes forming a stack comprising alternating layers of unfinished glass sheets and spacer pads. The stack is such that there is no physical contact between any two adjacent unfinished glass sheets and outer edges of the spacer pads are recessed relative to outer edges of the unfinished glass sheets. The stack is secured by clamping the unfinished glass sheets and spacer pads together and then supported on a working surface. The unfinished glass sheets of the stack are finished simultaneously while the stack is supported on the working surface. After the finishing, the stack comprises alternating layers of finished glass sheets and spacer pads.

15 Claims, 4 Drawing Sheets

METHOD AND SYSTEM FOR FINISHING GLASS SHEETS

CROSS-REFERENCE TO RELATED APPLICATIONS

This application claims the benefit of priority under 35 U.S.C. §119 of U.S. Provisional Application Ser. No. 61/624,584 filed on Apr. 16, 2012, the content of which is relied upon and incorporated herein by reference in its entirety.

BACKGROUND

The invention relates to processes for finishing glass sheets.

Glass sheets may have rough edges that must be finished prior to their use in target applications. Typically, finishing is a combination of grinding and polishing to remove material from the rough edges and thereby smooth out the rough edges. In some cases, finishing may include lapping. A typical finishing scheme includes grinding the rough outer edges of the glass sheets, one glass sheet at a time, followed by polishing the rough inner edges of the glass sheets, one glass sheet at a time. After this initial outer edge grinding and inner edge polishing for each glass sheet, the glass sheets are stacked together in physical contact. Then, the outer edges of the stacked glass sheets are polished together. Finally, the glass sheets are separated. Throughput is relatively low with this finishing scheme.

SUMMARY

In one aspect of the present invention, a method of finishing glass sheets includes forming a stack having alternating layers of unfinished glass sheets and spacer pads. The stack is such that there is no physical contact between any two adjacent unfinished glass sheets. The stack is also such that outer edges of the spacer pads are recessed relative to outer edges of the unfinished glass sheets. The method includes securing the stack by clamping the unfinished glass sheets and spacer pads together. The secured stack is supported on a working surface. The method includes finishing the unfinished glass sheets of the stack simultaneously while the stack is supported on the working surface. After the finishing, the stack has alternating layers of finished glass sheets and spacer pads.

In one embodiment, the finishing of the glass sheets includes removing material from rough edges of the unfinished glass sheets.

In one embodiment, the finishing of the glass sheets includes grinding the outer edges of the unfinished glass sheets simultaneously.

In one embodiment, the grinding of the outer edges includes a plurality of grinding passes, where each grinding pass involves use of an abrasive material with a predetermined grit size.

In one embodiment, the predetermined grit size decreases with each successive grinding pass.

In one embodiment, the grinding of the outer edges includes shaping the outer edges of the unfinished glass sheets.

In one embodiment, the finishing of the glass sheets further includes polishing the outer edges of the unfinished glass sheets simultaneously.

In one embodiment, the polishing of the glass sheets includes a plurality of polishing passes.

In one embodiment, the method further includes forming holes in the unfinished glass sheets before or during the finishing, where the holes are bounded by inner edges.

In one embodiment, the finishing of the glass sheets includes polishing the inner edges simultaneously.

In one embodiment, the method further includes forming slots in the outer edges of the unfinished glass sheets before or during the finishing.

In one embodiment, the securing of the stack includes placing the stack in a magnetizer fixture that applies a magnetic clamping force to the stack.

In one embodiment, the supporting of the stack includes aligning the stack to a working position on the working surface and clamping the stack to the working surface at the working position.

In one embodiment, the finishing of the glass sheets occurs without altering the layer arrangement of the stack throughout the finishing.

In one embodiment, the finishing of the glass sheets includes use of a plurality of finishing tools operated by a computer numerical control machine.

In one embodiment, the finishing of the glass sheets includes separating the finished glass sheets from the spacer pads.

In one embodiment, the method further includes removing the stack from the working surface and immersing the stack in a liquid medium prior to the separating of the finished glass sheets from the spacer pads.

In another aspect of the present invention, a system of finishing glass sheets includes a plurality of finishing tools, where each finishing tool is configured to perform at least one of grinding and polishing. The system includes a computer numerical control machine capable of operating the plurality of finishing tools. The system includes a replaceable stack mounted on a working surface of the machine in a position to be acted on by a finishing tool operated by the machine. The replaceable stack includes alternating layers of unfinished glass sheets and spacer pads. The replaceable stack is such that there is no physical contact between any two adjacent unfinished glass sheets. The replaceable stack is also such that outer edges of the spacer pads are recessed relative to outer edges of the unfinished glass sheets. The system includes means for clamping the unfinished glass sheets and the spacer pads together.

In one embodiment, the system further includes means for clamping the replaceable stack to the working surface.

In one embodiment, the means for clamping the unfinished glass sheets and spacer pads together includes a magnetizer fixture capable of applying a magnetic clamping force to the replaceable stack.

In one embodiment, the spacer pads are made of a conformable material.

The foregoing summary and the following detailed description are exemplary of the invention and are intended to provide an overview or framework for understanding the nature and character of the invention as it is claimed. The accompanying drawings are included to provide a further understanding of the invention and are incorporated in and constitute a part of this specification. The drawings illustrate various embodiments of the invention and together with the description serve to explain the principles and operation of the invention.

BRIEF DESCRIPTION OF THE DRAWINGS

The following is a description of the figures in the accompanying drawings. The figures are not necessarily to scale, and certain features and certain views of the figures may be shown exaggerated in scale or in schematic in the interest of clarity and conciseness.

DETAILED DESCRIPTION

Figure 1:
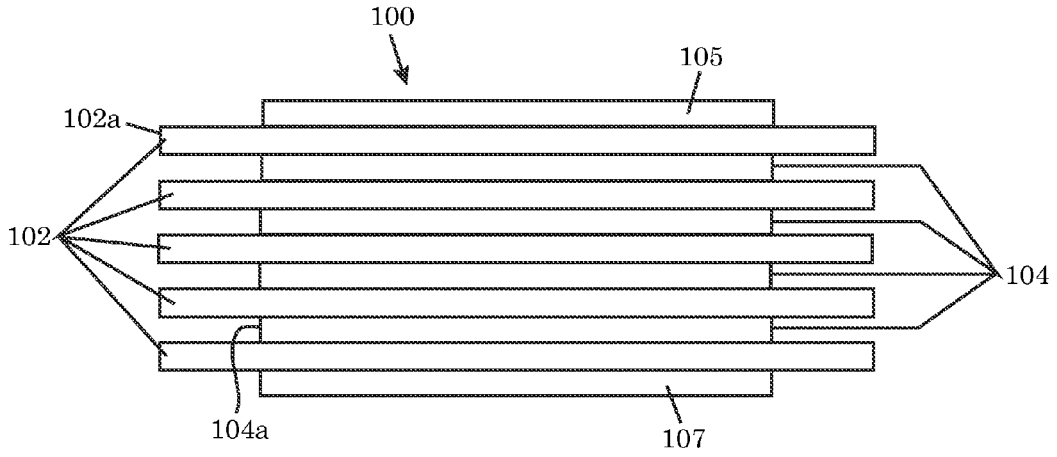
FIG. 1 is a schematic of a stack of glass sheets interleaved with spacer pads.

In the following detailed description, numerous specific details may be set forth in order to provide a thorough understanding of embodiments of the invention. However, it will be clear to one skilled in the art when embodiments of the invention may be practiced without some or all of these specific details. In other instances, well-known features or processes may not be described in detail so as not to unnecessarily obscure the invention. In addition, like or identical reference numerals may be used to identify common or similar elements.

A method of finishing glass sheets according to one embodiment of the invention involves providing a plurality of unfinished glass sheets. Here, the term "unfinished glass sheet" refers to a glass sheet having one or more rough edges that need to be finished. A rough edge may include micron-scale breaks and chips. An edge may be considered rough if it has a surface roughness greater than 350 nm, as measured by a ZYGO® Newview 3D optical surface profiler. Each unfinished glass sheet is bounded by an outer (circumferential) edge, which may be rough and require finishing. The outer edge may be considered to be rough even if only a portion of the outer edge is rough. In this case, the required finishing may be only where the outer edge is rough. Each unfinished glass sheet may have one or more holes, each of which is bounded by an inner (circumferential) edge, where the inner edge may be rough and require finishing. The inner edges and outer edges may define a variety of shapes, e.g., rectangle, square, circle, and oval, depending on the target applications of the finished glass sheets. The unfinished glass sheets are typically flat.

The unfinished glass sheets may be strengthened glass sheets, i.e., glass sheets that have been subjected to a chemical strengthening process, such as an ion-exchange process, or a thermal strengthening process, such as annealing. The base compositions of the glass sheets are selected based on the target applications of the glass sheets and may be further selected based on the strengthening processes that would be applied to the glass sheets. For example, where strong glass sheets are desired and an ion-exchange process is to be used for strengthening of the glass sheets, the base compositions of the glass sheets would need to be ion-exchangeable. Ion-exchangeable glasses are characterized by the presence of small alkali metal or alkaline-earth metal ions that can be exchanged for larger alkali or alkaline-earth metal ions. Typically, ion-exchangeable glasses are alkali-aluminosilicate glasses or alkali-aluminoborosilicate glasses. Specific examples of ion-exchangeable glasses are disclosed in U.S. Pat. No. 7,666,511 (Ellison et al; 20 Nov. 2008), U.S. Pat. No. 4,483,700 (Forker, Jr. et al.; 20 Nov. 1984), and U.S. Pat. No. 5,674,790 (Araujo; 7 Oct. 1997); U.S. patent application Ser. No. 12/277,573 (Dejneka et al.; 25 Nov. 2008), Ser. No. 12/392,577 (Gomez et al.; 25 Feb. 2009), Ser. No. 12/856,840 (Dejneka et al.; 10 Aug. 2010), Ser. No. 12/858,490 (Barefoot et al.; 18 Aug. 18, 2010), and Ser. No. 13/305,271 (Bookbinder et al.; 28 Nov. 2010); and U.S. Provisional Patent Application No. 61/503,734 (Dejneka et al.; 1 Jul. 2011).

The method includes forming a stack including several unfinished glass sheets interleaved with spacer pads. The spacer pads may be made of conformable material so that the shape of the spacer pads conforms to that of the adjacent unfinished glass sheets. The stack has at least two unfinished glass sheets. Preferably, the stack has more than two unfinished glass sheets. In some embodiments, the stack has at least five unfinished glass sheets. The unfinished glass sheets and spacer pads are arranged in alternating layers so that there is no physical contact between any two adjacent unfinished glass sheets.

For illustration purposes, FIG. 1 shows a stack 100 including unfinished glass sheets 102 interleaved with spacer pads 104. The height of the spacer pads 104 may depend on a particular finishing tool that will be applied to the glass sheets 102, as will be further discussed below. An end pad 105 may be placed on top of the stack 100 to protect the topmost unfinished glass sheet 102. Similarly, an end pad 107 may be placed below the bottom of the stack 100 to protect the bottommost unfinished glass sheet 102. The spacer pads 104 are preferably made of materials that would not scratch or mar the surface of the unfinished glass sheets 102. For example, the spacer pads 104 could be made of a polymeric material, such as butyl rubber, silicone, polyurethane, or natural rubber. The spacer pads 104 are selected to be smaller in size than the unfinished glass sheets 102 and stacked in such a way that their outer (circumferential) edges 104*a* are recessed in the stack 100 relative to the outer edges 102*a* of the unfinished glass sheets 102. This would allow free access to the outer edges 102*a* of the unfinished glass sheets 102 for the purpose of finishing the outer edges 102*a*. The end pads 105, 107 may have the same characteristics as the spacer pads 104.

The method includes securing the stack 100 by clamping the unfinished glass sheets 102 and the spacer pads 104 together so that there is no relative motion between the unfinished glass sheets 102 and the spacer pads 104. Any suitable method may be used to secure the stack 100. Preferably, the method of securing the stack 100 will not interfere with finishing of the outer edges 102*a* of the unfinished glass sheets 102.

Figure 2:
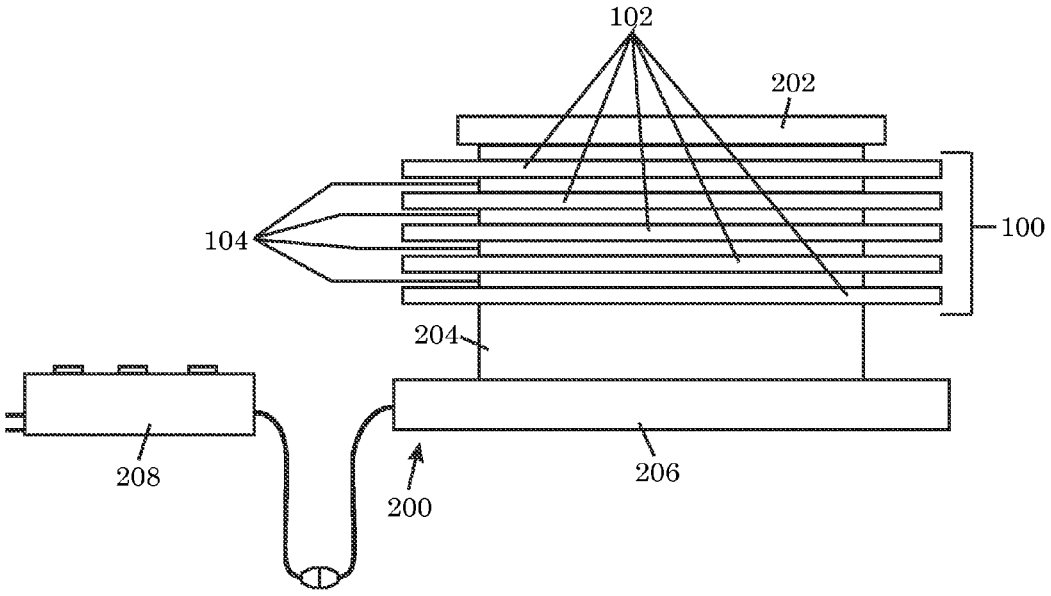
FIG. 2 is a schematic of a stack of glass sheets and spacer pads clamped in a magnetizer fixture.

In one embodiment, as shown in FIG. 2, a magnetizer fixture 200 is used to clamp the glass sheets 102 and the spacer pads 104 of the stack 100 together. The magnetizer fixture 200 includes a cover part 202 made of one or more magnets and a base part 204 made of one or more magnets. In one embodiment, each of the cover part 202 and base part 204 is made of an electromagnet. The parts 202, 204 may be in the form of plates. The cover part 202 is positioned over the base part 204 and spaced apart from the base part 204 to create a gap sufficient to accommodate the height of the stack 100. The base part 204 is mounted on a magnetizer 206. There should be some physical contact between the base part 204 and the magnetizer 206. However, whole surface contact between the base part 204 and magnetizer 206 is not necessary. When the magnetizer 206 receives current and is energized, it applies a magnetic field in the vicinity of the parts 202, 204 to draw the cover part 202 to the base part 204, thereby clamping the stack 100 in between the plates 202, 204. The clamping force applied to the stack 100 is proportional to the current delivered to the magnetizer 206. This current can be adjusted by or through the magnetizer controller 208. The magnetizer 206 may be obtained from commercial vendors and may be further customized to provide sufficient magnetic power to clamp the stack 100 in between the parts 202, 204.

Other methods of clamping the unfinished glass sheets 102 and the spacer pads 104 together besides magnetic means may be used. For example, the stack 100 may be sandwiched between plates and a weight may be applied to one of the plates to clamp the stack 100 in between the plates.

Figure 3:
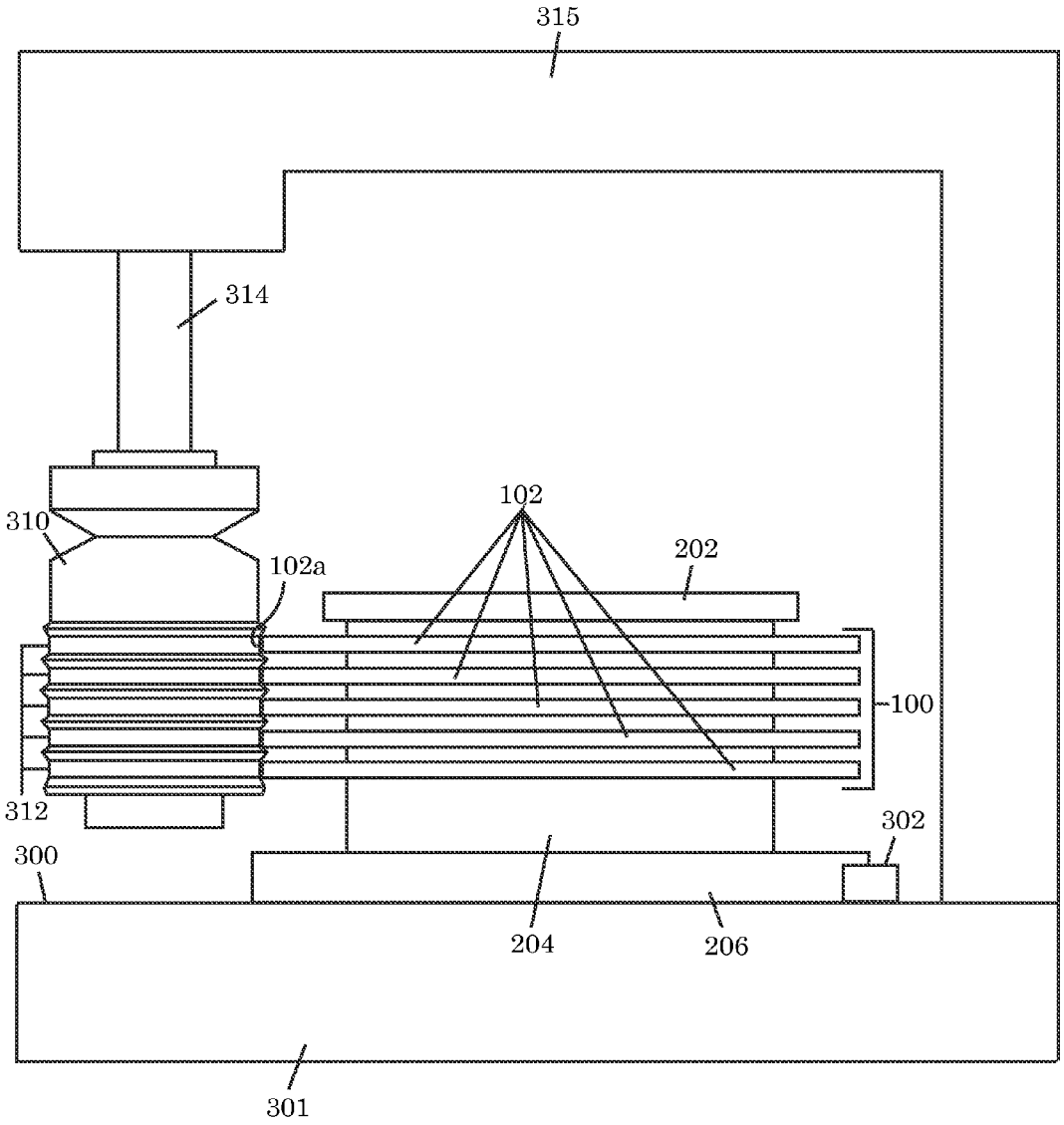
FIG. 3 is a schematic of simultaneous grinding of the outer rough edges of glass sheets in a stack.

The method includes placing the stack 100 in its secured (clamped) state on a working surface, such as a working surface of a computer numerical control ("CNC") machine. FIG. 3 shows the stack 100 on a working surface 300 of a CNC machine 315. The stack 100 is aligned to a working position on the working surface 300, e.g., using one or more alignment blocks 302, and then secured in that position. Vacuum clamping or other means of maintaining the working position of the stack 100 on the working surface 300 may be used. The base 301, which provides the working surface 300, may incorporate the clamping means, such as port(s) through which vacuum can be applied to the secured stack 100. The CNC machine 315 may be obtained from commercial vendors. One example of a suitable CNC machine is CL-3MGC CNC machine, available from Chuan Liang Industrial Co., Ltd. Any commercial CNC machine used may be further customized as needed to hold and operate a selection of finishing tools, such as grinding and polishing tools.

After the stack 100 is secured in the working position, finishing tools are applied to the unfinished glass sheets 102 to finish the unfinished glass sheets 102 simultaneously, i.e., each application of the finishing tool involves interaction between the finishing tool and all the glass sheets in the stack at the same time. Finishing of the unfinished glass sheets 102 can take on various forms. Typically, finishing will include grinding the outer edges 102*a* of the unfinished glass sheets 102 simultaneously, followed by polishing the outer edges 102*a* of the unfinished glass sheets 102 simultaneously. If the unfinished glass sheets 102 have holes in them and these holes are aligned in the stack 100, finishing may include polishing the inner edges defining the aligned holes simultaneously. Additional processes may be carried out before or during the finishing. For example, slots may be punched in the outer edges 102*a* of the glass sheets 102 and then finished along with the outer edges 102*a*. In another example, holes may be punched through the unfinished glass sheets 102 in the stack 100 and then polished simultaneously.

In one embodiment, as shown in FIG. 3, the outer edges 102*a* of the unfinished glass sheets 102 are finished simultaneously using a grinding tool 310. The grinding tool 310 has a plurality of circumferential, axially spaced-apart notches 312. The surfaces defining the notches 312 incorporate abrasive material for grinding. Alternatively, the grinding tool 310 may be made wholly of an abrasive material. The material may be selected from, for example, alumina, silicon carbide, diamond, cubic nitride, and pumice. The spacing between the notches 312 corresponds to the spacing between the unfinished glass sheets 102 so that there is a one-to-one correspondence between the notches 312 and the outer edges 102*a* of the unfinished glass sheets 102. The profiles of the notches 312 are selected based on the desired profiles of the outer edges 102*a* after grinding. For example, the notches 312 may have a flat, round, or beveled profile to make the outer edges 102*a* flat, round, or beveled, respectively. The notches 312 may have identical or different profiles.

The grinding tool 310 is mounted on a spindle 314 to rotate with the spindle 314 or about the spindle 314. For finishing, the grinding tool 310 is rotated while being translated along the outer edges 102*a*. The CNC machine 315 controls rotation and translation of the grinding tool 310. As the grinding tool 310 is rotated and translated, each of the notches 312 engages a corresponding one of the outer edges 102*a*. In the engaged position, the abrasive material in the notches 312 and the relative motion between the notches 312 and outer edges 102*a* result in removal of material from the outer edges 102*a*. How much material is removed will depend on the grit size of the abrasive material and the grinding force due to contact between the grinding tool 310 and the outer edges 102*a*. The grinding may occur in several passes, with each successive pass possibly using a different grit size. Grit size may be changed by replacing the grinding tool 310 with another grinding tool having the appropriate grit size. In general, the higher the grit size, the less aggressive is the removal of material from the outer edges 102*a*. Typically, the grit size will increase with each successive pass. For example, a 350 mesh grit size (corresponding to diamond grain size of about 40 μm) may be used for the beginning pass (or passes), and 600 mesh grit size (corresponding to diamond grain size of about 24 μm) may be used for the final pass (or passes). For each pass, the grinding tool 310 may traverse the entire length of each outer edge 102*a* or just a portion of the entire length of each outer edge 102*a*, depending on how much of each outer edge 102*a* requires finishing.

Figure 4:
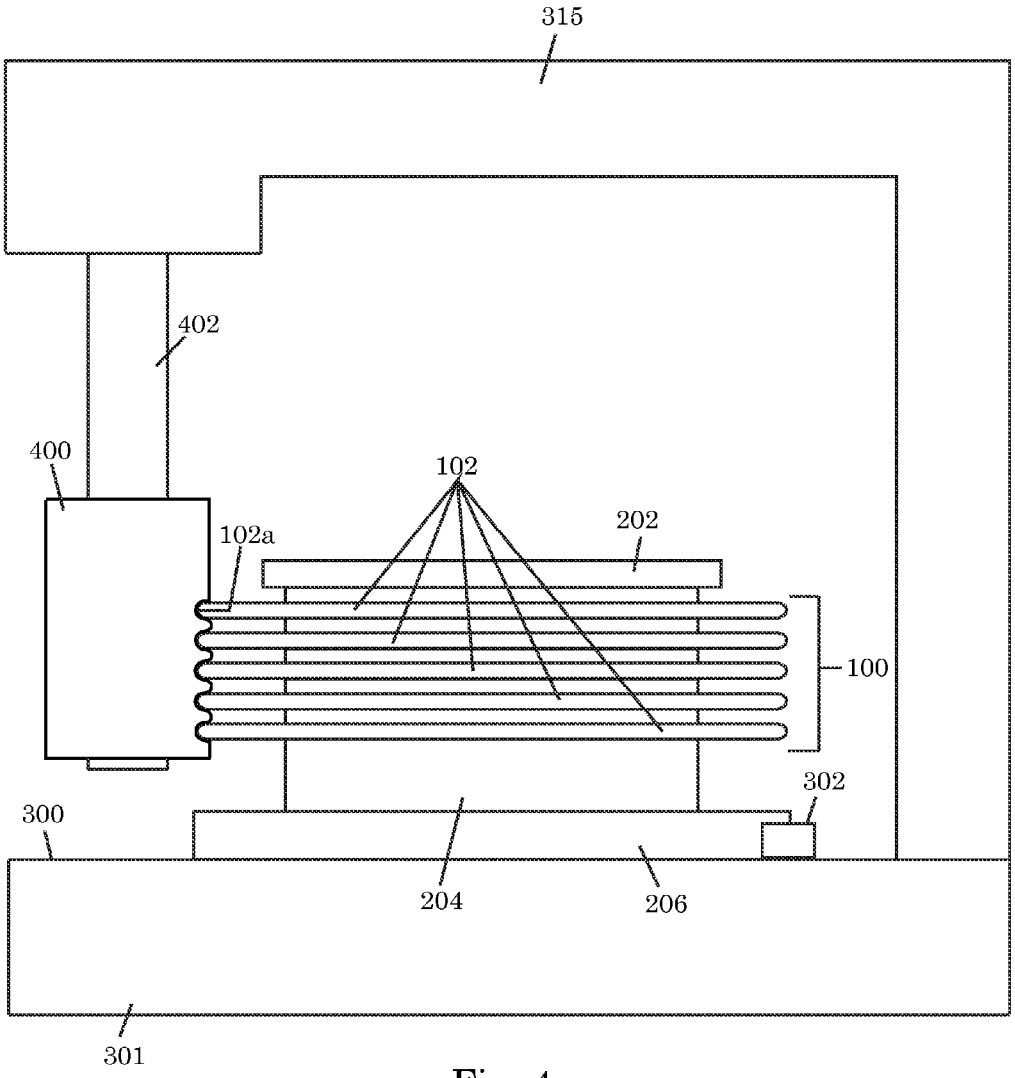
FIG. 4 is a schematic of simultaneous polishing of the outer rough edges of glass sheets in a stack.

In one embodiment, as shown in FIG. 4, after grinding, the outer edges 102*a* are polished simultaneously using a polishing tool 400 operated by the CNC machine 315. The polishing tool 400 may be, for example, in the form of a wheel or pad or brush. Preferably, the polishing tool 400 is made of a conformable material so that it can conform to the shape of the outer edges 102*a*. The polishing tool 400 may be made of a polymeric material, such as butyl rubber, silicone, polyurethane, and natural rubber. Abrasive material is not incorporated into the polishing tool 400 as in the case of the grinding tool 310 (in FIG. 3). However, polishing can involve use of abrasive particles. In one example, 8000 mesh abrasive particles may be used. The abrasive particles may be provided in dry or slurry form. An amount of the abrasive particles is applied onto a surface of the polishing tool 400, and the polishing tool 400 rubs or brushes the abrasive particles against the outer edges 102*a* during the polishing. Polishing with the polishing tool 400 may occur in several passes as in the case of grinding. The polishing tool 400 is translated along the outer edges 102*a* for the polishing. The polishing tool 400 may be mounted on a spindle 402, which may allow rotation of the polishing tool 400 while the polishing tool 400 is being translated along the outer edges 102*a*.

Other methods of polishing may be used. For example, magnetorheological finishing ("MRF") as taught in U.S. Patent Application Publication No. 2011/0318994 ("Darcangelo et al.") may be used for the polishing. In MRF, micron-sized to nano-sized magnetizable particles are suspended in a liquid vehicle to form a magnetorheological polishing fluid (MPF). The MPF is deposited on a support surface and a magnetic field is applied to the MPF. The magnetized MPF becomes stiffened and usable as a polishing tool. The stiffened MPF can be brought into contact with the outer edges 102*a* of the unfinished glass sheets 102 to polish the outer edges 102*a*.

Figure 5:
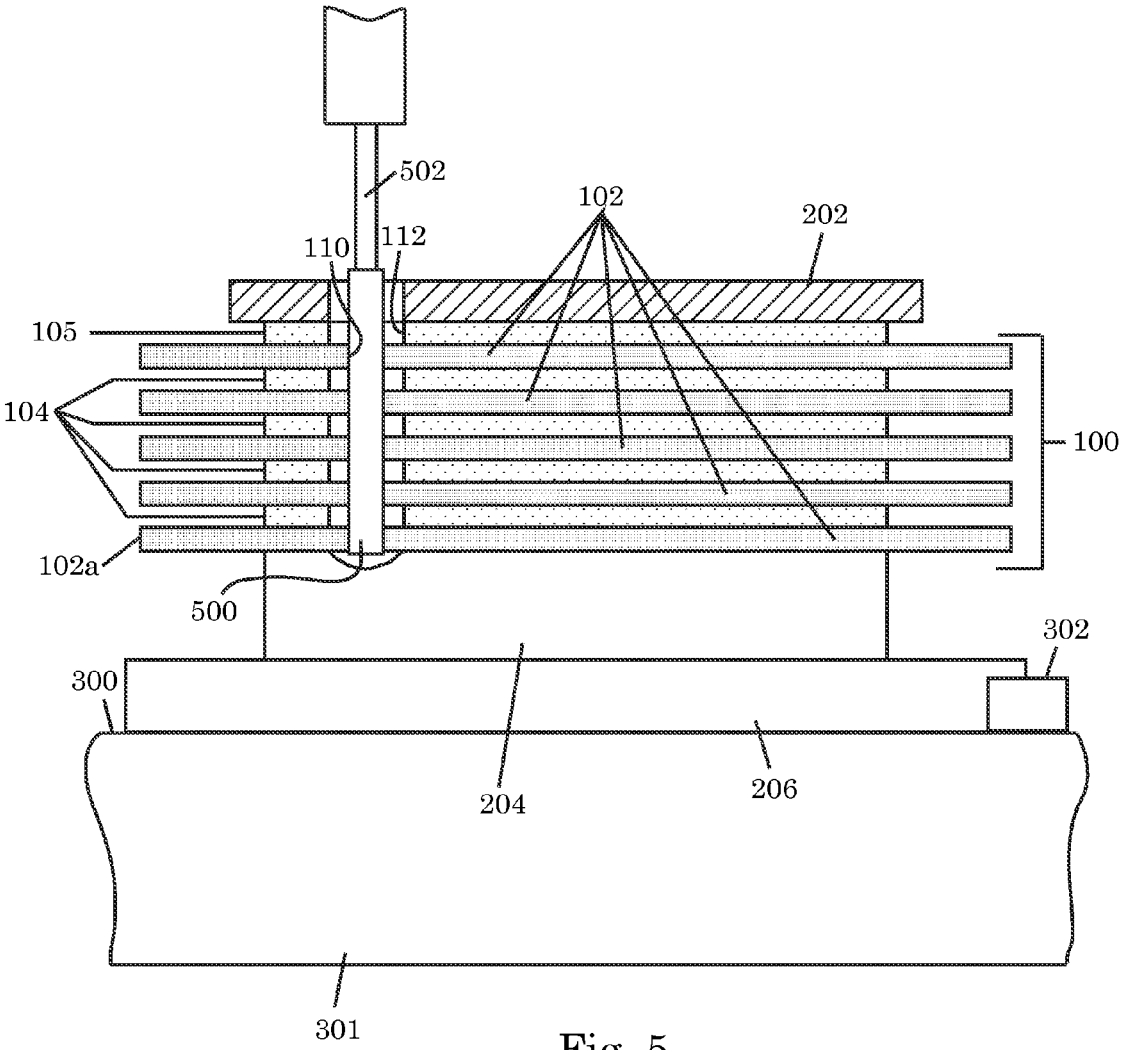
FIG. 5 is a schematic of simultaneous polishing of the inner rough edges of glass sheets in a stack.

In one embodiment, as shown in FIG. 5, each of the unfinished glass sheets 102*a* has a hole 110, and the holes 110 are aligned when the unfinished glass sheets 102*a* are in the stack 100. The spacer and end pads 104, 105 also have holes 112 that are aligned with the holes 110. The spacer pad holes 112 are bigger than the glass sheet holes 110 so that the spacer pad holes 112 are recessed relative to the glass sheet holes 110 from the viewpoint of the glass sheet holes 110. With this configuration, the spacer and end pads 104, 105 will not interfere with polishing of the glass sheet holes 110.

A polishing tool 500 is inserted into the aligned glass sheet holes 110 to polish the inner edges of the glass sheets 102 defining (or bounding) the holes 110. In one embodiment, the polishing tool 500 has the same characteristics as the polishing tool 400 (in FIG. 4) described above, except that the polishing tool 500 is shaped for insertion into the aligned glass sheet holes 110. The polishing tool 500 may be mounted on a spindle or handle 502, which can allow rotation or translation of the polishing tool 500 within the aligned glass sheet holes 110. Rotation and/or translation of the polishing tool 500 can be controlled by the CNC machine (315 in FIGS. 3 and 4). It is also possible to use other methods of polishing the glass sheet holes 110. For example, a stiffened MPF in tubular form may be inserted into the aligned glass sheet holes 110 and used to polish the aligned glass sheet holes 110.

The holes 110 may be pre-punched in the unfinished glass sheets 102 before forming the stack 100. Alternatively, the holes 110 may be punched in the unfinished glass sheets 102 after forming the stack 100 using a suitable hole punching tool. This punching may occur at any time during the finishing of the outer edges 102*a* or before the finishing of the outer edges 102*a*. After punching, the holes 110 can be finished as described above.

The entire finishing can occur without having to alter the layer arrangement of the stack 100 at any point during the finishing. The entire finishing can also occur without having to remove the stack 100 from the working surface 300 at any point during the finishing. Being able to load the stack 100 onto a CNC machine once and finish the stack 100 without having to unload and change the configuration of the stack 100 at any point during the finishing saves time and leads to a higher throughput.

The glass sheets 102 in the stack 100 that have been finished as described above have smooth inner and outer edges. In one embodiment, the roughness of the outer and inner edges of the glass sheets 102 after finishing as described above is less than 100 nm, as measured by a ZYGO® Newview 3D optical surface profiler.

After the glass sheets 102 in the stack 100 have been finished as described above, the means for clamping the glass sheets 102 to the spacer pads 104 is removed. Then, the finished glass sheets 102 are separated from the spacer pads 104. Since there is no direct contact between adjacent glass sheets 102, unstacking of the finished glass sheets 102 involves mainly lifting layers of the stack 100 (i.e., lifting a glass sheet, then a spacer pad, one at a time). If desired, the stack 100 may be immersed in a fluid medium prior to being unstacked and then unstacked while in the fluid medium.

After the finished glass sheets have been removed from the stack, the finished glass sheets can be subjected to additional processes, such as a strengthening process. In one embodiment, the finished glass sheets are subjected to an ion-exchange process. For the ion-exchange process to work, the glass sheets would have to be made of ion-exchangeable glass, as already described above. Pre-finishing strengthening of the glass sheets may not be needed if the finished glass sheets will be subjected to a post-finishing strengthening process. In some cases, the finishing of the glass sheets may be sufficient such that strengthening of the glass before or after finishing is not needed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A method of finishing glass sheets, comprising:

forming a stack comprising alternating layers of unfinished glass sheets and spacer pads, the stack being such that there is no physical contact between any two adjacent unfinished glass sheets and outer edges of the spacer pads are recessed relative to outer edges of the unfinished glass sheets;

securing the stack by clamping the unfinished glass sheets and spacer pads together in a magnetizer fixture that applies a magnetic clamping force to the stack;

placing the stack, in its secured state, on a working surface;

supporting the stack that has been secured on a working surface;

finishing the unfinished glass sheets of the stack simultaneously while the stack is supported on the working surface, wherein after the finishing the stack comprises alternating layers of finished glass sheets and spacer pads;

forming holes in the unfinished glass sheets before or during the finishing, the holes being bounded by inner edges; and removing the stack, in its secured state, from the working surface, wherein the finishing comprises grinding the outer edges of the unfinished glass sheets simultaneously, the finishing comprises polishing the inner edges simultaneously, and the entire finishing occurs without unsecuring the stack or removing the stack from the working surface.

2. The method of claim 1, wherein the finishing comprises removing material from rough edges of the unfinished glass sheets.

3. The method of claim 1, wherein the grinding comprises a plurality of grinding passes, each grinding pass involving use of an abrasive material with a predetermined grit size.

4. The method of claim 3, wherein the predetermined grit size decreases with each successive grinding pass.

5. The method of claim 1, wherein the grinding comprises shaping the outer edges of the unfinished glass sheets.

6. The method of claim 1, wherein the finishing further comprises polishing the outer edges of the unfinished glass sheets simultaneously.

7. The method of claim 6, wherein the polishing comprises a plurality of polishing passes.

8. The method of claim 1, further comprising forming slots in the outer edges of the unfinished glass sheets before or during the finishing.

9. The method of claim 1, wherein the supporting comprises aligning the stack to a working position on the working surface and clamping the stack to the working surface at the working position.

10. The method of claim 1, wherein the finishing occurs without altering the layer arrangement of the stack throughout the finishing.

11. The method of claim 1, wherein the finishing comprises use of a plurality of finishing tools operated by a computer numerical control machine.

12. The method of claim 1, further comprising separating the finished glass sheets from the spacer pads.

13. The method of claim 12, further comprising removing the stack from the working surface and immersing the stack in a liquid medium prior to the separating.

14. A system of finishing glass sheets, comprising:

a plurality of finishing tools, each finishing tool configured to perform at least one of grinding and polishing;

a computer numerical control machine capable of operating the plurality of finishing tools;

a replaceable stack mounted on a working surface of the machine in a position to be acted on by a finishing tool operated by the machine, the replaceable stack comprising alternating layers of unfinished glass sheets and spacer pads, the replaceable stack being such that there is no physical contact between adjacent unfinished glass sheets and outer edges of the spacer pads are recessed relative to outer edges of the unfinished glass sheets; and a magnetizer fixture capable of applying a magnetic clamping force to the replaceable stack that clamps the unfinished glass sheets and the spacer pads together, wherein the stack is placed onto the working surface in its secured state, the stack is removed from the working surface in its secured state the outer edges of the unfinished glass sheets are ground simultaneously, the inner edges are polished simultaneously, and the grinding and polishing are conducted without unsecuring the stack or removing the stack from the working surface.

15. The system of claim 14, wherein the spacer pads are made of conformable material.

* * * * *